United States Patent [19]

Tokunaga et al.

[11] Patent Number: 4,783,507

[45] Date of Patent: Nov. 8, 1988

[54] NOVEL POLYETHYLENE SYNTHETIC PULP

[75] Inventors: Teruo Tokunaga; Masahiro Sugi, both of Ichihara, Japan

[73] Assignee: Mitsui Petrochemical Industries, Ltd., Tokyo, Japan

[21] Appl. No.: 651,508

[22] Filed: Sep. 12, 1984

Related U.S. Application Data

[63] Continuation of Ser. No. 538,010, Sep. 30, 1983, abandoned.

[30] Foreign Application Priority Data

Sep. 30, 1982 [JP] Japan ..... 57-172976

[51] Int. Cl.[4] ..... C08L 23/06

[52] U.S. Cl. ..... 525/240; 526/352; 526/352.2; 524/487; 162/157.5; 264/DIG. 26

[58] Field of Search ..... 525/240, 931; 524/487; 162/157.5

[56] References Cited

U.S. PATENT DOCUMENTS

| | | | |
|---|---|---|---|
| 3,097,991 | 7/1963 | Miller et al. | 525/240 |
| 3,993,718 | 11/1976 | Bontinck et al. | 525/931 |
| 4,260,565 | 4/1981 | D'Amico et al. | 525/931 |

OTHER PUBLICATIONS

Boenig-"Polyolefins"-11/66, p. 81.
Renfrew et al-"Polythene"-1/61, p. 287.

*Primary Examiner*—Carman J. Seccuro
*Attorney, Agent, or Firm*—Armstrong, Nikaido, Marmelstein & Kubovcik

[57] ABSTRACT

Disclosed is a novel polyethylene synthetic pulp giving synthetic paper which may be heat-treated with a heating apparatus attached to a conventional papermaking machine. The polyethylene synthetic pulp comprises fibers of polyethylene which has an MFR (Melt Flow Ratio) of 0.1 to 3,000 g/10 min., and the portion with a low melting point thereof, which melts at a temperature of 95° C. or lower when measured with a DSC (Differential Scanning Calorimeter), is at least 20% by weight, preferably, 40% to 70%.

2 Claims, 4 Drawing Sheets

NOVEL POLYETHYLENE SYNTHETIC PULP

This is a continuation of application Ser. No. 538,010 filed Sept. 30, 1983, now abandoned.

BACKGROUND OF INVENTION

1. Field of the Invention

The present invention relates to a novel polyethylene synthetic pulp. More particularly, the invention relates to such a polyethylene synthetic pulp that gives synthetic paper which may be, after being made in a papermaking machine, heat-treated with a heating device attached to a conventional papermaking machine.

In the specification, by "polyethylene" it is meant not only homopolymers of etheylene, but also copolymers of ethylene with a minor amount of other olefins such as propylene, 1-butene and 4-methyl-1-pentene.

2. State of the Art

Synthetic pulp comprising short fibers of polyethylene is made into paper, as is, or usually, as a mixture with wood pulp or other materials, to form synthetic paper which is applied for various uses. The uses are found in various fields of industry, such as papermaking, e.g., water-resistant corrugated cardboard, water-resistant white cardboard, embossed paper, heat-sealing paper and battery separators; dry binders and dry nonwoven cloth, e.g., felt mats and hygienic absorbents; and building materials mainly for replacement of conventional asbestos products.

To meet the demands in variety, many grades of synthetic pulp are prepared. Synthetic pulp products use polyethylenes of different physical properties, such as specific gravity, softening point or melting point, heat of fusion and mechanical strength, and properties depending on the shape of the pulp fibers, such as fiber length, diameter, surface area and filtrage.

One of the merits of synthetic pulp is that the material polyethylene is thermoplastic, and therefore, that the product synthetic paper obtains higher strength and smoothness, lower moisture permeability, and further, that the synthetic paper becomes transparent and may be processed by deep-drawing.

In the production of synthetic paper using a polyethylene synthetic pulp now on the market, the synthetic pulp is usually mixed in an appropriate ratio with wood pulp, and the mixture is made into paper in a conventional papermaking machine which is used for making plain paper. It is necessary to heat-treat the synthetic paper thus made, after drying, in a special heating device so that the synthetic paper may exhibit the above-noted properties.

Dryers and calendering rolls in conventional papermaking machines are heated by steam and operated at a drying temperature ranging from 90° C. to 100° C., usually a little higher than 95° C.

Grades of conventional polyethylene synthetic pulp are divided broadly into two groups from the viewpoint of the material: those with high-density polyethylene and those with medium-density polyethylene. None of these polyethylenes melt or soften at a temperature in the above-noted range of operating temperatures of conventional heating devices. Thus, heat treatment of the synthetic pulp requires a special device.

In order to produce synthetic pulp suitable for papermaking, it was proposed to flash-spin a mixture of homogeneous phases of two different polymers (Japanese Patent Publication No. 32123/1982 or U.S. Pat. No. 4,260,565). The proposed method is directed to formation of fibers with a higher extent of fibrillation, and the disclosure contains no solution for the above-noted problem in papermaking using the synthetic pulp.

SUMMARY OF THE INVENTION

We noted that it would be convenient for production of the synthetic paper if the special heating device were not required, and if the heat treatment could be performed with usual dryers or calender rolls which are attached to conventional papermaking machines. This could reduce production costs of the synthetic paper and, as a result, expand the uses thereof.

The object of the present invention is to provide such a polyethylene synthetic pulp that gives a synthetic paper which may be, after being made in a papermaking machine, heat-treated with a heat-treating device attached to a conventional papermaking machine.

The novel polyethylene synthetic pulp, giving synthetic paper which may be heat-treated with a conventional heating apparatus according to the present invention, comprises fibers of polyethylene which has an MFR (Melt Flow Ratio, measured by the method defined in JIS K-6760) of 0.1 to 3000 g/10 min., and the portion with a low melting point thereof, which melts at a temperature of 95° C. or lower when measured with a DSC (Differential Scanning Calorimeter), is at least 20% by weight.

BRIEF DESCRIPTION OF DRAWINGS

FIGS. 2 through 4 are DSC curves of various polyethylene synthetic pulps used in the example described later:

FIG. 4 shows the DSC curv of a paraffin wax.

PREFERRED EMBODIMENTS OF THE INVENTION

The MFR of the polyethylene should be up to 3,000 g/10 min. for the purpose of obtaining fibrous material therefrom. Polymers of higher MFR tend to become powder and give little fiber. Also, it is difficult to form fibers with a polymer having an MFR of 0.1 g/10 min. or less. Preferable range of MFR is from 0.5 to 500 g/10 min.

Figure 1:
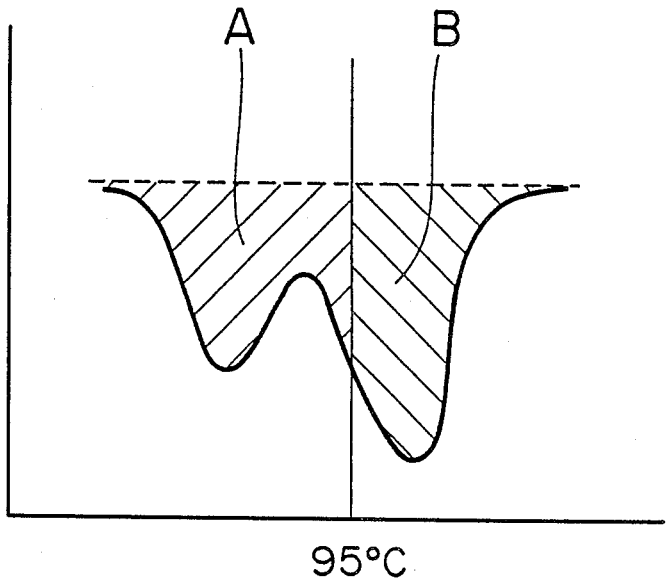
FIG. 1 is a schematic graph of a DSC curve for explanation of the melting property of the polyethylene synthetic pulp according to the present invention.
Figure 2A:
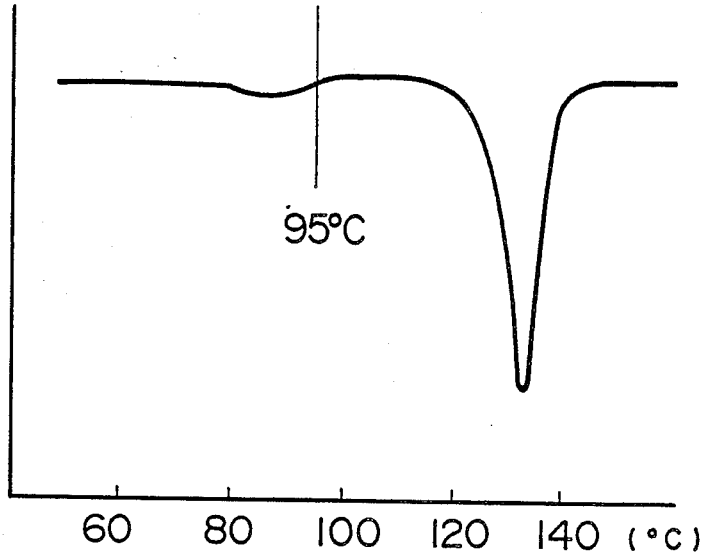
FIG. 2A and FIG. 2B show the DSC curves of conventional polyethylene synthetic pulps.
Figure 2B:
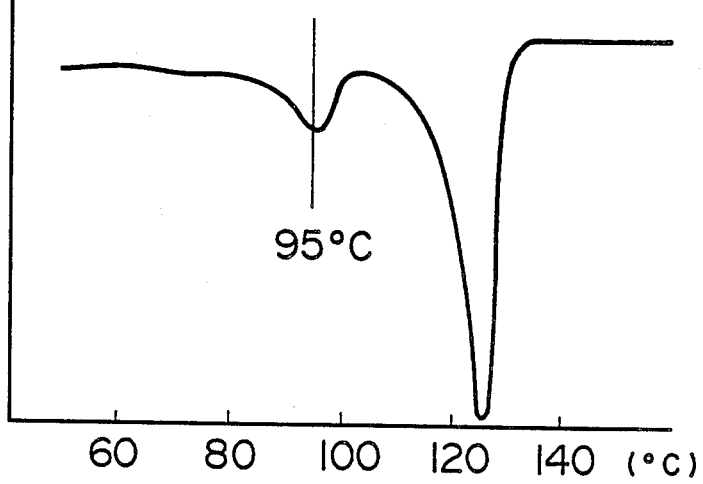
Figure 3A:
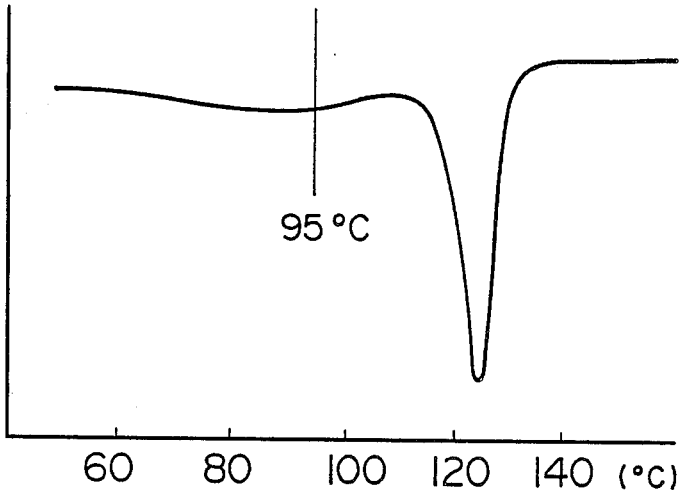
FIG. 3A and FIG. 3B show DSC curves of the polyethylene synthetic pulp according to the present invention.
Figure 3B:
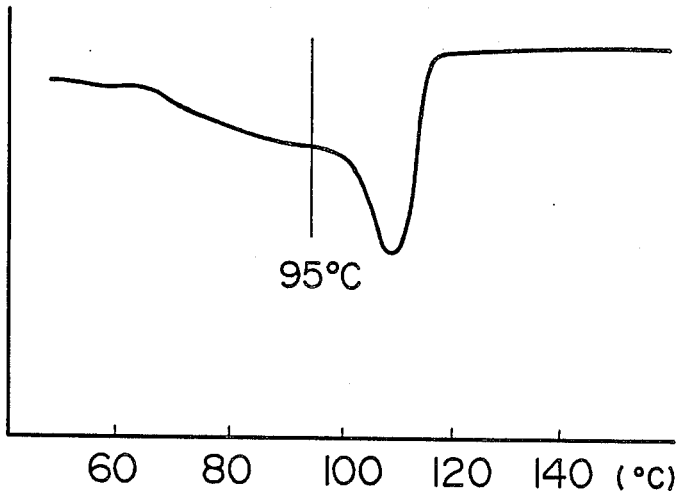
Figure 4:
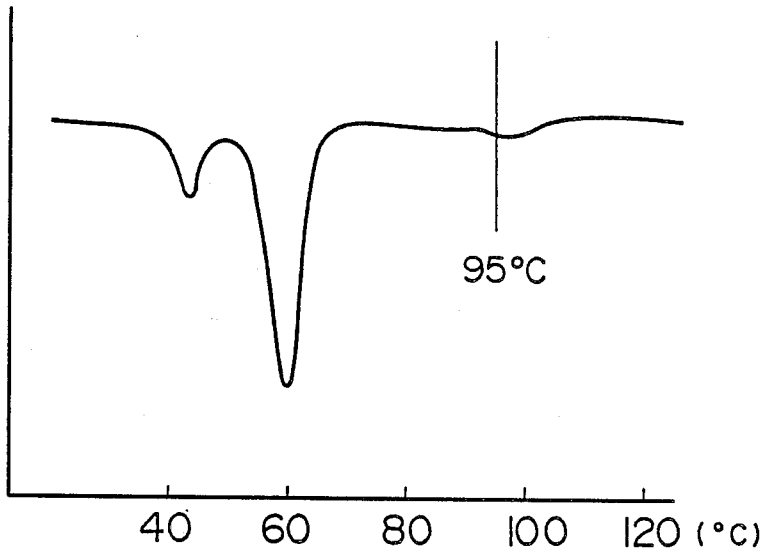

The portion with a low melting point determined by DSC analysis is defined by the formula:

$$A/(A+B)\times 100(\%)$$

wherein, in FIG. 1 showing a typical DSC curve, of the area defined by the curve and the base line, A is the area of temperatures lower than 95° C., and B is the area of temperatures higher than 95° C. According to our experience, in order that the synthetic pulp paper can be heat-treated with the conventional dryer or callender roll of a papermaking machine, it is necessary that the portion with a low melting point is 20% or more. Preferable range is from 40% to 70%. Contents of this portion in conventional polyethylenes for synthetic pulp are: about 2% in high-density polyethylenes, and about 10% even in medium-density polyethylenes.

One method of preparing polyethylene with the above-noted characteristics is the method called "parallel polymerization", which comprises producing a polyethylene of relatively low molecular weight in one reactor and producing a polyethylene of relatively high molecular weight in another reactor, and then mixing the product polyethylenes prior to forming the fibers thereof.

As another method of preparing the above polyethylene, the technology of "two-step polymerization" can be used. Production of polyethylene of relatively low molecular weight, the first step of ethylene polymerization, may be carried out according to the technology disclosed in Japanese Patent Publication No. 40594/1979. Production of polyethylene of relativly high molecular weight, the second step of ethylene polymerization, may be performed in accordance with the conventional technology or the same with slight modification. A typical method is described in Japanese Patent Publication No.19407/1972. In any case, the polyethylene component of relatively low molecular weight should amount to at least 20% of the polyethylene to be fiberized.

The method of producing synthetic pulp from the above-obtained polyethylene may be substantially identical with the conventional method of making pulp from polyethylene. A number of technologies are known, and among them, typical methods are those disclosed in Japanese Patent Publication No. 47049/1977, or U.S. Pat. No. 3,920,508, and Japanese Patent Publication No. 36249/1979.

The novel polyethylene synthetic pulp according to the present invention gives a synthetic paper which can be heat-treated with a conventional dryer or calender, and therefore, without a special apparatus or an additional step, strong synthetic paper with a smooth surface can be prepared. Furthermore, the low melting point polyethylene has properties similar to those of wax. Therefore, there is an additional merit of reduced adhesion of the synthetic paper to the dryer, resulting in improved peelability of the paper therefrom. Needless to say, these merits improve efficiency and yield of production of the synthetic paper.

EXAMPLE

A polyethylene of relatively low molecular weight was produced according to the method described in Japanese Patent Publication No. 40594/1979, by using a catalyst made of triethyl aluminum and co-ground magnesium chloride and titanium tetrachloride, and after feeding hydrogen into a hexane medium under a hydrogen partial pressure of 10 kg/cm$^2$G, continuously feeding ethylene to maintain the total pressure at 40 kg/cm$^2$ G and the temperature at 140° C. Another polyethylene of relatively high molecular weight was produced in the same manner with an initial hydrogen partial pressure of 0.7 kg/cm$^2$ G.

Choosing different mixing ratios of the above-noted polyethylenes, there were obtained two polyethylene compounds having different portions with a low melting point.

These polyethylene compounds were processed according to the method of preparing pulpy material disclosed in Japanese Patent Publication No. 47049/1977, or U.S. Pat. No. 3,920,508, i.e., flashing of polymer emulsion, to form the synthetic pulp.

The MFR and the portions with a low melting point of thus-obtained polyethylene compounds are shown below in comparison with those of conventional synthetic pulps made of a high-density polyethylene, a medium-density polyethylene and a paraffin wax.

| No. | Sample | MFR | Portion with Low M.P. |
|---|---|---|---|
| 2A | High-Density Polyethylene | 2.5 | 2% |
| 2B | Medium-Density Polyethylene | 5.0 | 10 |
| 3A | Polyethylene-1 of the Present Invention | 55 | 33 |
| 3B | Polyethylene-2 of the Present Invention | 150 | 52 |
| 4 | paraffin wax | $10^7$ | 95 |

The DSC charts of these samples are shown in the Figures, with the numbers of the Figures corresponding to the respective sample numbers. The DSC analysis was conducted under conditions in which the temperature of the samples was increased from normal temperature to 200° C. at the rate of 10° C./min.

The above-mentiond synthetic pulps(SWP) were mixed with a wood pulp(LBKP, non-beaten) at a mixing ratio of SWP:LBKP =70:30 (weight, dry basis), and the resulting pulp mixture, using a conventional papermaking machine, was made into a mixed paper of unit weight 150 g/m$^2$. Surface temperature of the dryer was 95° C. to 100° C.

The synthetic papers from the synthetic pulp of the polyethylenes 3A and 3B, according to the present invention, were somewhat transparent and smooth at the surface and had low moisture permeability because of partial melting of the synthetic pulp to form films. The peelability of the synthetic pulp from the dryer was good. On the other hand, the synthetic papers made from the synthetic pulp of the conventional polyethylenes 2A and 2B, had the appearance of just-made paper, and it was necessary to further heat-treat at a higher temperature to give the final product.

Separately, the above-mentioned synthetic pulps were mixed with the wood pulp(LBKP, non-beaten) in the ratio of SWP:LBKP =40:60, and the resulting mixed pulp, using a conventional papermaking machine, was made into mixed papers of unit weight 60 g/m$^2$.

A calender roll was operated at temperatures from 90° C. to 100° C. for calendering the above-obtained mixed papers. Inspection of adhesion to the roll found that the mixed papers using the conventional polyethylene synthetic pulp more or less adhered to the roll, but the mixed papers using the polyethylene according to the present invention did not substantially adhere.

We claim:

1. A novel polyethylene synthetic pulp comprising fibers of polyethylene having an MFR, Melt Flow Ratio, of 0.5 to 500 g/10 min. and at least 20% by weight of said polyethylene fibers having a low melting point which melts at a temperature of 95° C. or lower when measured with a DSC, Differential Scanning Calorimeter, the remainng portion, if any, being less than 80% by weight of the synthetic pulp, having a higher melting point than 95° C. when meansured with a DSC.

2. A novel polyethylene synthetic pulp according to claim 1, wherein the polyethylene and the portion with a low melting point is 40% to 70% by weight.

* * * * *